US006056206A

United States Patent [19]

Whiton

[11] Patent Number: 6,056,206

[45] Date of Patent: May 2, 2000

[54] COMBINATION STRAW, STIRRER AND CITRUS FRUIT SQUEEZER

[76] Inventor: Ian Whiton, 1368 E. 18th St., Suite 2R, Brooklyn, N.Y. 11230

[21] Appl. No.: 09/206,485

[22] Filed: Dec. 7, 1998

[51] Int. Cl.[7] ..... A47G 21/18

[52] U.S. Cl. ..... 239/33; 30/142; D7/300.2; 220/705; 215/388

[58] Field of Search ..... 239/33; 30/324, 30/142, 141; D7/300.2; 220/90.2, 705, 709; 215/388; 206/217; 100/102

[56] References Cited

U.S. PATENT DOCUMENTS

| | | | |
|---|---|---|---|
| 1,847,879 | 3/1932 | Knecht . | |
| 2,370,931 | 3/1945 | Bogin et al. | 239/33 |
| 2,613,107 | 10/1952 | Hartnett . | |
| 2,979,267 | 4/1961 | Miller . | |
| 3,211,379 | 10/1965 | Burton | 239/33 |
| 3,315,405 | 4/1967 | Hoffer . | |
| 3,438,527 | 4/1969 | Gamblin, Jr. | 239/33 |
| 3,464,344 | 9/1969 | Hawthorne | 100/102 |
| 4,441,640 | 4/1984 | Lottick | 220/90.2 |
| 4,928,876 | 5/1990 | Marshall | 220/90.4 |
| 4,930,652 | 6/1990 | Murphy et al. | 220/90.2 |
| 5,038,476 | 8/1991 | McCrea | 239/33 |
| 5,673,789 | 10/1997 | Degraff-Eugene | 206/217 |
| 5,727,321 | 3/1998 | Lewis | 30/141 |

*Primary Examiner*—Andres Kashnikow
*Assistant Examiner*—Dinh Q. Nguyen
*Attorney, Agent, or Firm*—Michael I. Kroll

[57] ABSTRACT

The present invention 10 discloses a device having a generally upright standing straw or tube member 18 having an aperture 26 therein which runs the full length of the tube 18 therein. The tube 18 has a bottom base plate 20 located on its lower end which is attached to the tube 18 and supported by brace members 22 near the bottom of the tube 18. The aperture 26 of the tube 18 extends through the base plate 20. The base plate 20 is equipped with numerous protrusions 30 on its underside which are used to crush and extract juice and pulp from slices of fruit 14 in the drink mixture 16. The present invention is also equipped with longitudinal vertical slots or apertures 28 located between the multiple buttresses 22 which slots 28 serve as means to prevent the tube or straw 18 from becoming clogged with pulp or sealed to the drink vessel by providing additional ingress into the tube 18. Alternative embodiments of the present invention are provided which allow the base plate to be formed into recognizable shapes such as a bottle or lemon, or having a contoured edge 34 to aid in the juice extraction process.

16 Claims, 11 Drawing Sheets

COMBINATION STRAW, STIRRER AND CITRUS FRUIT SQUEEZER

BACKGROUND OF THE INVENTION

1. Field of the Invention

The present invention relates generally to drinking straws and more specifically to a tube having an upper aperture for drawing beverages therethrough and a base plate having a plurality of buttresses attached thereto for the purposes of attachment to the tube as well as acting as blades to mix the ingredients therein and between said buttresses having vertical slot apertures providing additional ingress and a non-clogging feature to said invention and wherein on the external surface of said base plate are arrayed a number of projections for the purpose of crushing and extracting juice and pulp from slices of fruit immersed within said beverage and wherein said base plate can be formed into any number of recognizable shapes, such as a bottle or a lemon, or can be formed with a contour to aid in the extraction process on a curved surface.

2. Description of the Prior Art

There are other drinking straws designed to crush and mix ingredients contained within a beverage. Typical of these is U.S. Pat. No. 1,847,879 issued to Knecht on Mar. 1, 1932.

Another patent was issued to Hoffer on Apr. 25, 1967 as U.S. Pat. No. 3,315,405. Yet another U.S. Pat. No. 2,979,267 was issued to Miller on Apr. 11, 1961 and still yet another was issued on Oct. 7, 1952 to Hartnett as U.S. Pat. No. 2,613,107.

U.S. Pat. No. 1,847,879

Inventor: A. C. Knecht

Issued: Mar. 1, 1932

This United States Patent discloses a device having a base plate and a tube having an aperture and extending through said base plate for the purposes of keeping the ice at the bottom of the drink container and drawing that portion of the beverage from the iced area of the glass.

U.S. Pat. No. 3,315,405

Inventor: A. L. Hoffer

Issued: Apr. 25, 1967

This United States Patent discloses an attachment to be placed on the end of a drinking straw that will rotate as a consequence of the movement of liquid through the drinking straw.

U.S. Pat. No. 2,979,267

Inventor: F. W. Miller

Issued: Apr. 11, 1961

This United States Patent discloses a drinking tube wherein a straw and a spoon having a common handle portion are combined to form a swizzle-stick drinking straw.

U.S. Pat. No. 2,613,107

Inventor: P. L. Hartnett

Issued: Oct. 7, 1952

This United States Patent discloses a combined swirling and mixing device and sipping straw for beverages wherein said sipping straw has a number of blades located at one end thereof for the purposes of crushing or muddling ice and mixed drink ingredients.

While these drinking straws may be suitable for the purposes for which they were designed, they would not be as suitable for the purposes of the present invention, as hereinafter described.

SUMMARY OF THE PRESENT INVENTION

The present invention discloses a device having a generally upright standing straw or tube member having an aperture therein which runs the full length of the tube therein. The tube has a bottom base plate located on its lower end which is attached to the tube and supported by brace members near the bottom of the tube. The aperture of the tube extends through the base plate. The base plate is equipped with numerous protrusions on its underside which are used to crush and extract juice and pulp from slices of fruit in the drink mixture. The present invention is also equipped with longitudinal vertical slots or apertures located between the multiple buttresses which slots serve as means to prevent the tube or straw from becoming clogged with pulp or sealed to the drink vessel by providing additional ingress into the tube. Alternative embodiments of the present invention are provided which allow the base plate to be formed into recognizable shapes such as a bottle or lemon, or having a contoured edge to aid in the juice extraction process.

A primary object of the present invention is to provide a drinking straw which can be used to extract juice and pulp from slices of fruit immersed within a beverage.

Another object of the present invention is to provide a drinking straw which can be used to mix the contents of a beverage.

Yet another object of the present invention is to provide a drinking straw which has a base plate which can be formed with or without a contour and can be manufactured into recognizable shapes.

Still yet another object of the present invention is to provide a drinking straw having a base plate having a number of protrusions which are arrayed on the external surface of said base plate and being formed into structures that will facilitate the removal of juice and pulp from slices of immersed fruit.

Additional objects of the present invention will appear as the description proceeds.

The present invention overcomes the shortcomings of the prior art by providing a drinking straw which can stir the ingredients of a beverage as well as having a base plate with a plurality of protrusions providing means for extracting juice and pulp from slices of fruit contained therein and wherein said base plate can be formed with or without a contour and can be formed into recognizable shapes.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
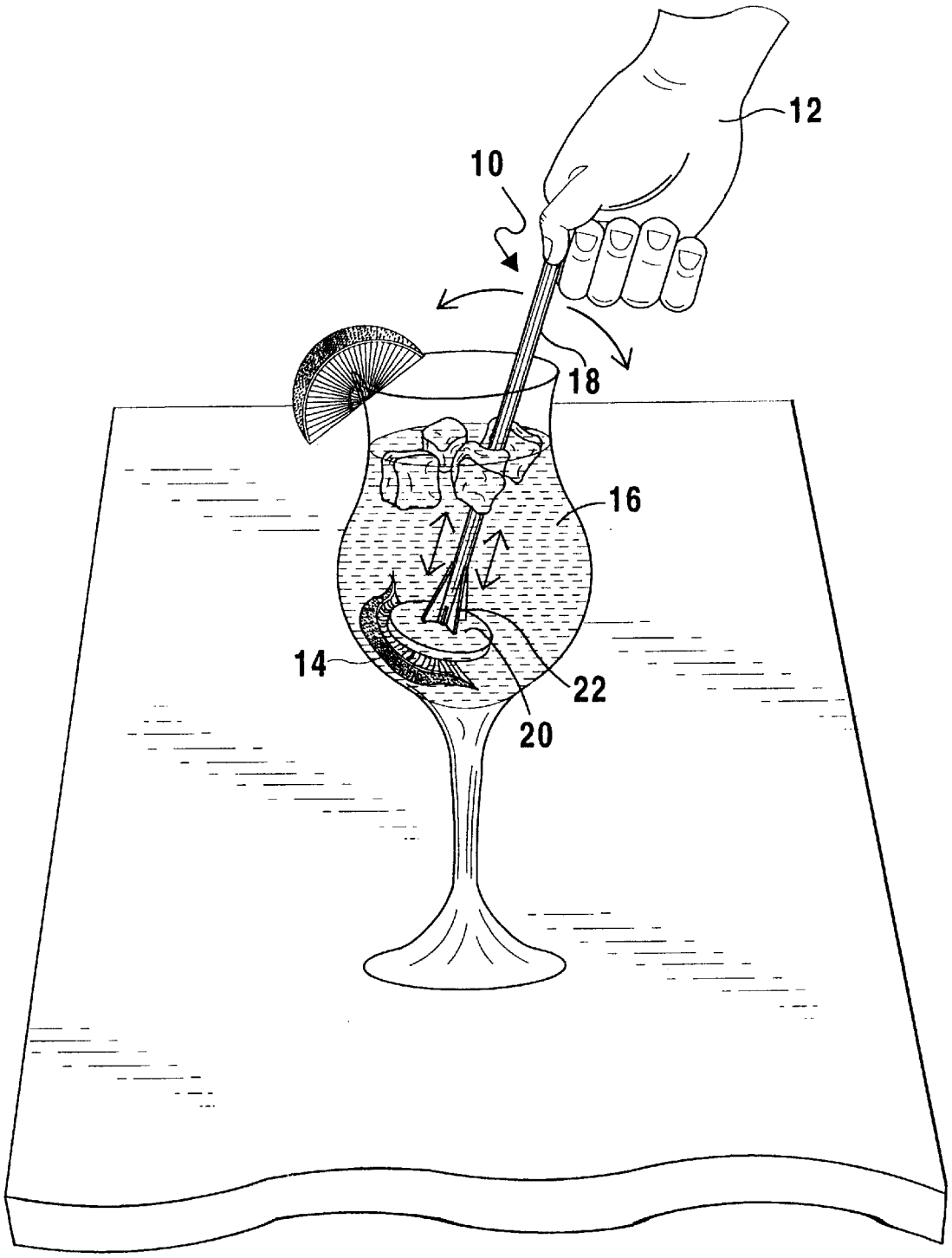
FIG. 1 is a perspective view of the present invention in use where an individual is using the invention to squeeze juice from a slice of fruit and mix it into the drink

With regard to the reference numerals used, the following numbering is used throughout the various figures.

10 present invention
12 user
14 fruit
16 drink
18 tube
20 base plate
22 brace
24 tube bottom opening
26 tube aperture
28 slots
30 protrusion
32 wall
34 contoured edge

DESCRIPTION OF THE PREFERRED EMBODIMENT(S)

Turning now descriptively to the drawings, in which similar reference characters denote similar elements throughout the several views, FIGS. 1 through 13 illustrate the present invention being a straw for sipping and mixing drinks.

Turning to FIG. 1, therein is shown a perspective view of the present invention 10 in use where an individual 12 is using the invention 10 to squeeze juice from a slice of fruit 14 and mix it into the drink 16. Also shown therein is the generally upright standing tube 18 which forms the basic unit of the straw of the invention which has an aperture (not shown) which runs its full length. Also shown is the base plate 20 in a plane perpendicular to the tube 18 which is used to crush fruit pieces along with the braces or buttresses 22 which forms a support means between the base plate 20 and the tube 18 and also help mix the drink by acting as a blade.

Figure 2:
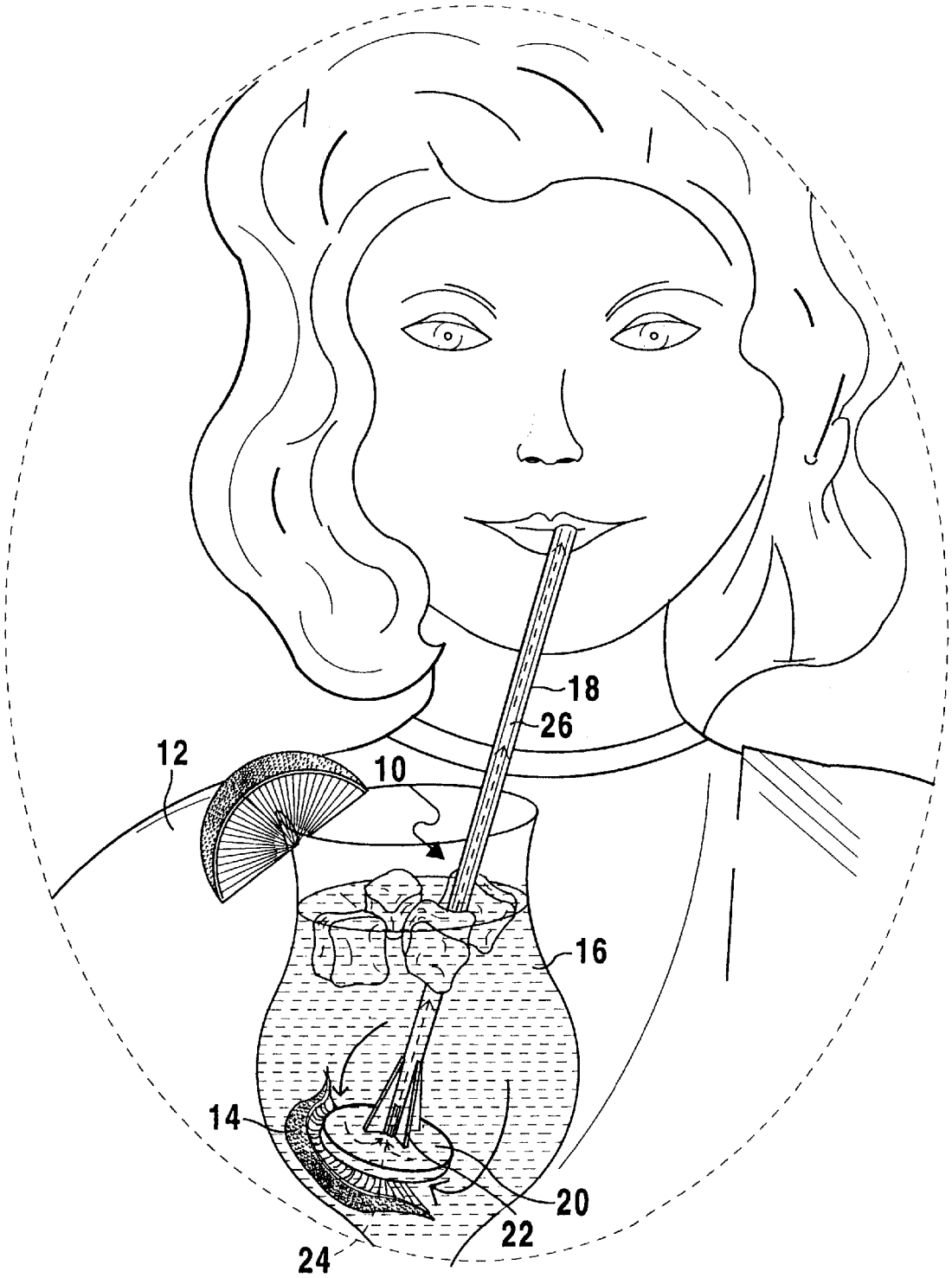
FIG. 2 is a perspective view of the present invention in use. Shown is an individual using the invention as a straw wherein the fluid of the drink is drawn from either the bore opening at one distal end of the straw and from the slot apertures located between the struts on said distal end.

Turning to FIG. 2, therein is shown a perspective view of the present invention 10 in use. Shown is an individual 12, the present invention 10 which is a straw with the fluid of the drink 16 being drawn from the lower opening 24 at the lower end of the straw and from the vertical slot apertures (not shown) located between the struts 22 on said lower end. Also shown therein is the tube 18 along with arrows showing the fluid flow in the tube aperture 26 on the interior of the tube 18 and the base plate 20.

Figure 3:
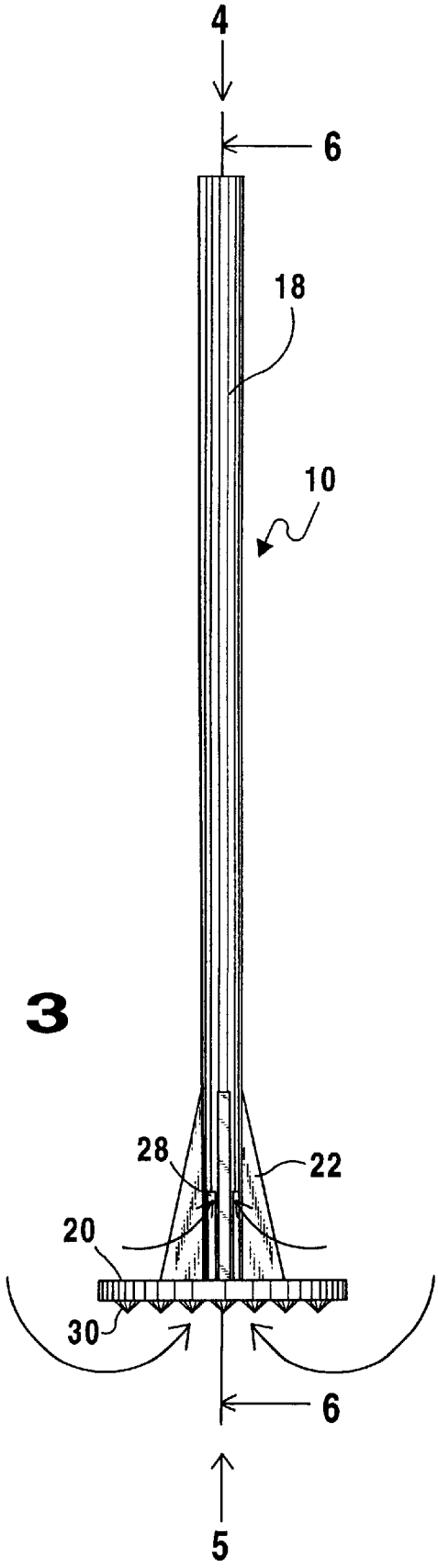
FIG. 3 is an elevation view of the present invention showing a straw having a plurality of apertures located at one distal end and having a plurality of buttresses connected to a base plate having a plurality of protrusions on the external plate surface for the purpose of extracting juice and pulp from a slice of fruit while being immersed in a drink.

Turning to FIG. 3, therein is shown an elevation view of the present invention 10 showing the straw 18 having a plurality of apertures or slots 28 located near the lower end and having a plurality of buttresses 22 connected to a base plate 20 having a plurality of protrusions 30 on the bottom or underside of the external plate surface for the purpose of crushing and extracting juice and pulp from fruit slices while the present invention 10 is immersed in the drink. The vertical slots 28 provide an additional opening for beverage into the tube 18 to prevent clogging and/or sealing of the tube to the drink vessel.

Figure 3A:
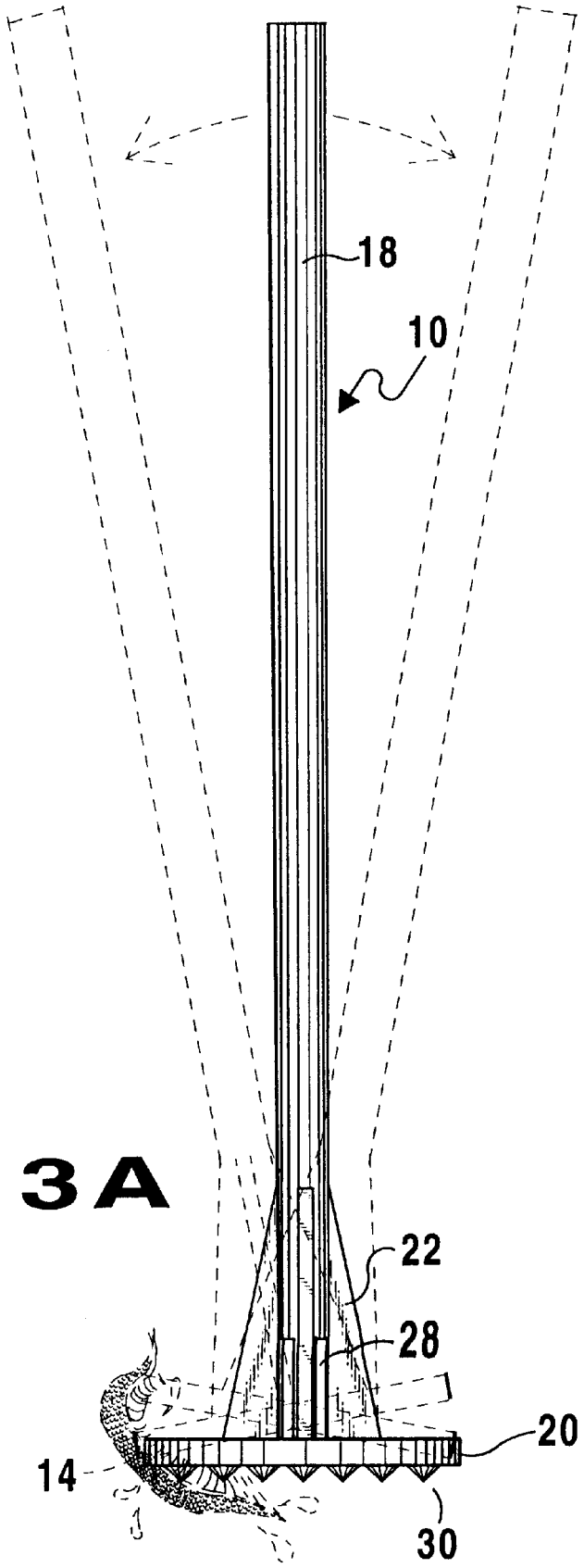
FIG. 3A is an elevation view of the present invention showing the invention extracting juice and pulp from a wedge of citrus fruit.

Turning to FIG. 3A, therein is shown an elevation view of the present invention 10 showing the invention extracting juice and pulp from the wedge of fruit 14 by using the present invention 10 to mash the fruit so as to extract juice and pulp from the fruit 14. This can be accomplished by rocking or moving the tube in an up-and-down motion or in a side-to-side motion as shown in FIG. 3A. It should be clear that the protrusions 30 act as a roughened surface to assist in removing juice and pulp from the fruit slices. Also shown are the braces 22, the base plate 20, along with the vertical slotted apertures 28.

Figure 3B:
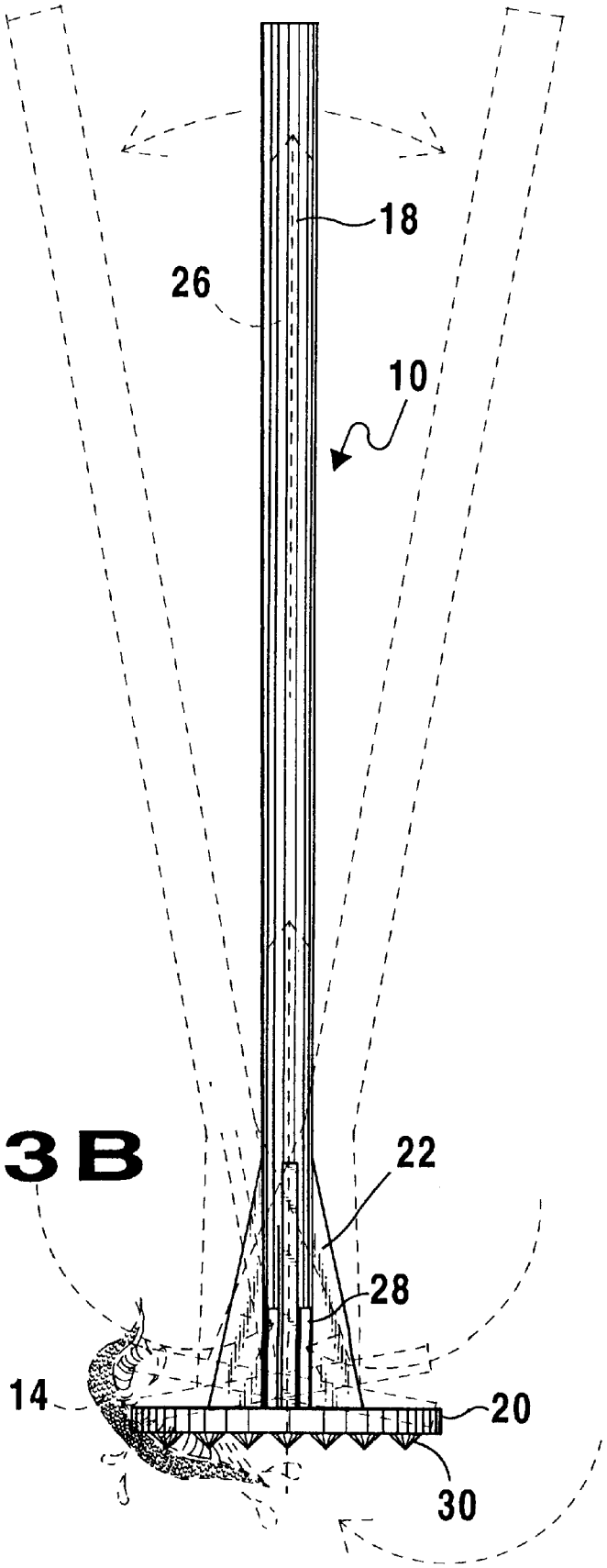
FIG. 3B is an elevation view of the present invention showing the invention extracting juice and pulp from a wedge of fruit and the path of the solution, through the bore of the straw and apertures in the wall, containing the mixture of the beverage, juice and pulp.

Turning to FIG. 3B, therein is shown an elevation view of the present invention 10 showing the invention extracting juice and pulp from the wedge of a fruit 14 and the path of the drink mixture shown traveling through the bore or aperture 26 of the tube 18. Also shown is the base plate 20, the braces 22, the protrusions 30 shaped as a cone along with the slot 28.

Figure 4:
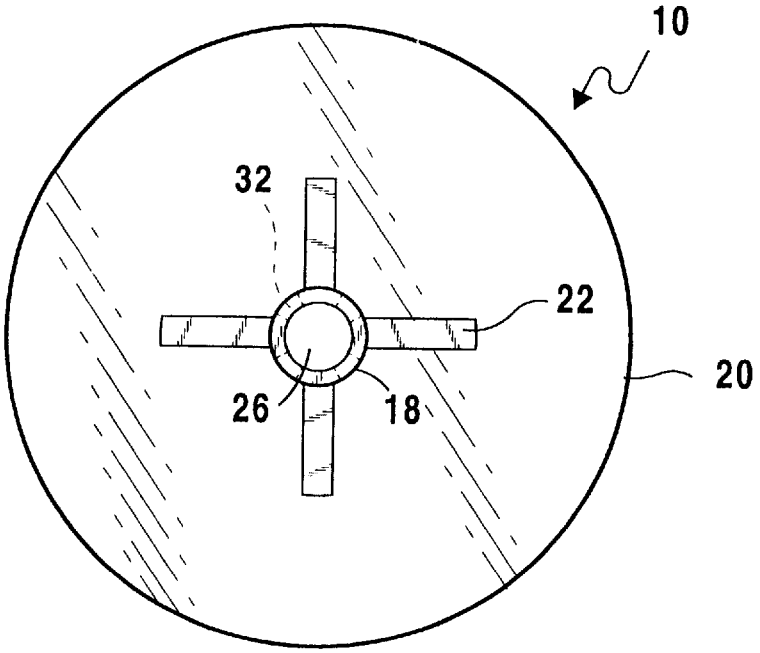
FIG. 4 is a top plan view, taken from FIG. 3 as indicated, of the present invention showing the bore and wall of the straw and a plurality of buttresses used as means of support and attachment of the base plate as well as acting as a number of blades to mix the extracted juice and pulp into the beverage.

Turning to FIG. 4, therein is shown a top plan view, taken from FIG. 3 as indicated, of the present invention 10 showing the bore or aperture 26 of the tube 18 along with the wall 32 of the tube and the plurality of braces or buttresses 22 used to support the attachment of the tube 18 and the base plate 20. The buttresses also act as a number of blades to mix the juice and pulp in the drink mixture.

Figure 5:
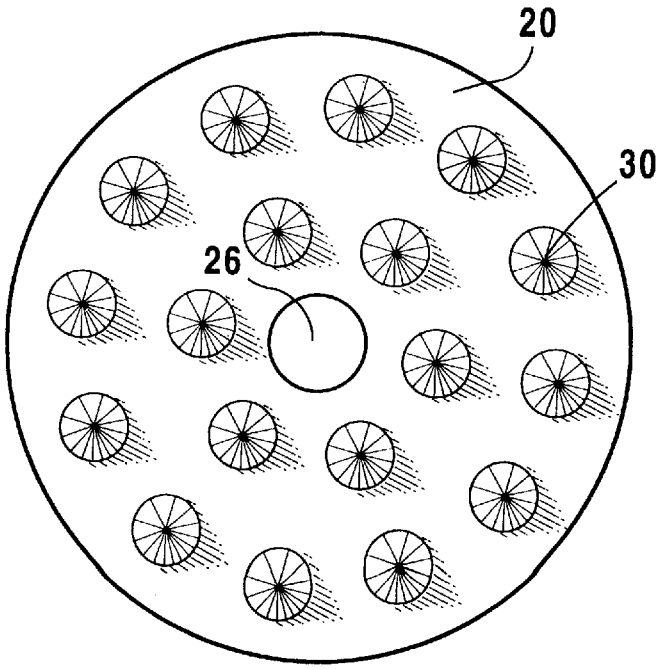
FIG. 5 is a bottom plan view, taken from FIG. 3 as indicated, showing the bore of the straw passing through the base plate and a plurality of protrusions arrayed on the external surface of said base plate and being constructed in such shapes as to facilitate the removal of juice and pulp from slices of fruit placed in a beverage.

Turning to FIG. 5, therein is shown a bottom plan view, taken from FIG. 3 as indicated, showing the bore 26 of the straw passing through the base plate 20 and a plurality of protrusions 30 located on the underside of the external surface of the base plate 20 being constructed in such shapes as to facilitate the removal of juice and pulp from slices of fruit placed in beverage.

Figure 6:
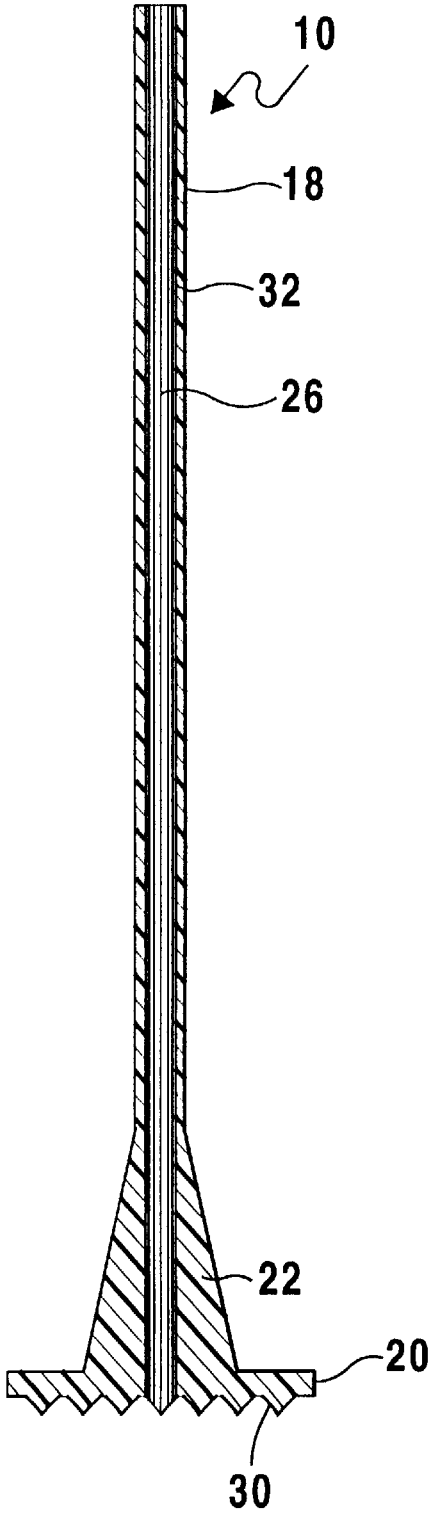
FIG. 6 is a cross sectional view, taken from FIG. 3 as indicated, showing the bore and wall of the straw, buttress, base plate and protrusions of the present invention.

Turning to FIG. 6, therein is shown a cross-sectional view, taken from FIG. 3 as indicated, showing the aperture 26 of the tube 18 along with the tube wall 32. Also shown are the braces 22, the base plate 20, along with the cone shaped protrusions 30. As can be seen, the aperture 26 travels the entire length of the present invention 10.

Figure 7:
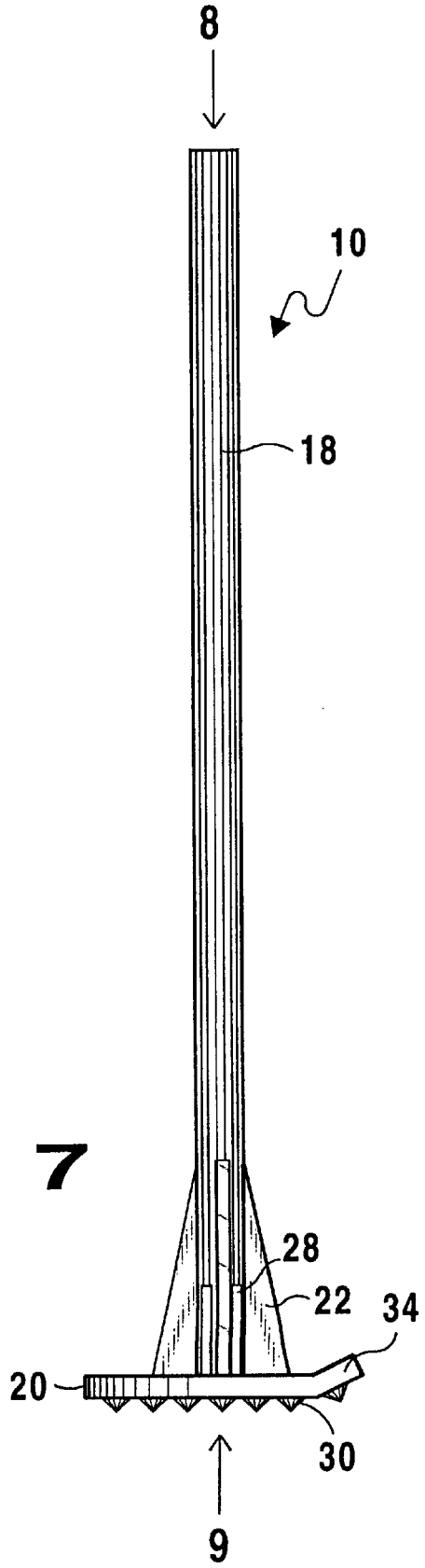
FIG. 7 is an elevation view of an alternate embodiment of the present invention. Shown is a straw having a plurality of apertures and having a plurality of buttresses connected to a contoured base plate having a plurality of protrusions on the external plate surface for the purpose of extracting juice and pulp from a slice of fruit while being immersed in a drink.

Turning to FIG. 7, therein is shown an elevation view of an alternative embodiment of the present invention 10. Shown is a straw having a plurality of vertical slot shaped apertures 28 and also having a plurality of buttresses 22 connected to a contoured base plate 20 having a contoured edge 34 having a plurality of protrusions 30 on the underside external plate surface for the purpose of extracting juice and pulp from a slice of fruit while being immersed in a drink. Also shown is the tube 18.

Figure 8:
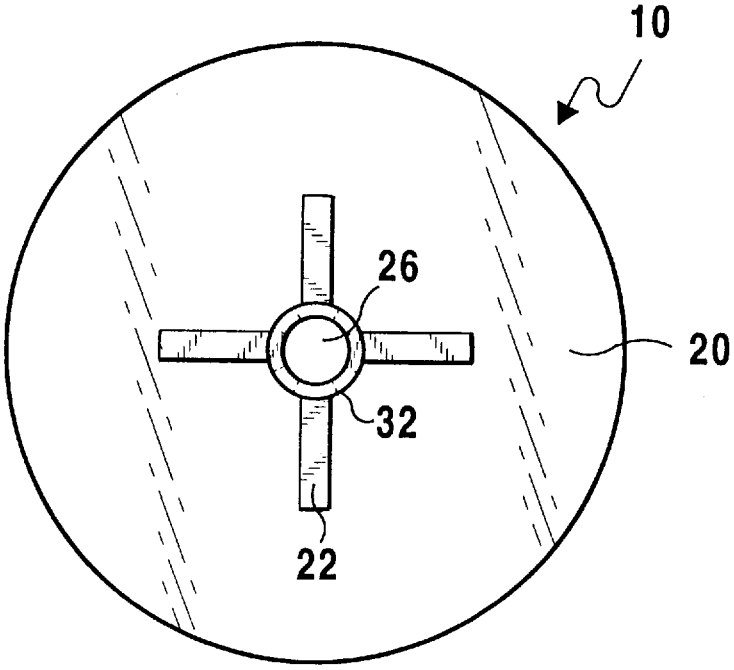
FIG. 8 is a top plan view, taken from FIG. 7 as indicated, of the alternate embodiment of the present invention showing the bore and wall of the straw and a plurality of buttresses used as means of support and attachment of the contoured base plate as well as acting as a number of blades to mix the extracted juice and pulp into the beverage.

Turning to FIG. 8, therein is shown a top plan view, taken from FIG. 7 as indicated, of an alternative embodiment of the present invention 10 showing the bore 26 and the wall 32 of the present invention along with a plurality of buttresses 22 used as a means of support and attachment of the contoured base plate 20 as well as acting as a number of blades to mix the extracted juice and pulp in the beverage.

Figure 9:
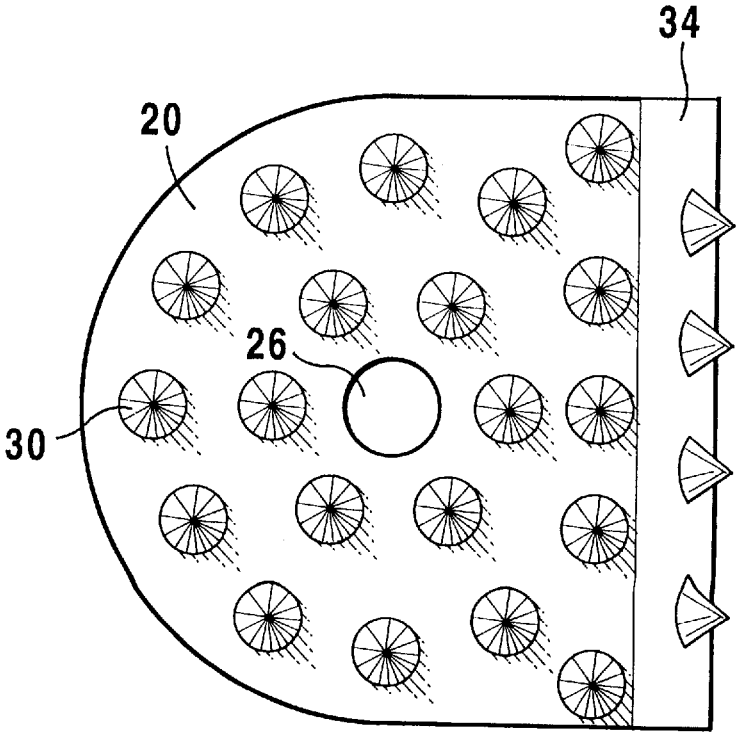
FIG. 9 is a bottom plan view, taken from FIG. 7 as indicated, of the alternate embodiment of the present invention. Shown is the bore of the straw passing through the contoured base plate and a plurality of protrusions arrayed on the external surface of said contoured base plate and being constructed in such shapes as to facilitate the removal of juice and pulp from slices of fruit placed in a beverage.

Turning to FIG. 9, therein is shown a bottom plan view, taken from FIG. 7 as indicated, showing the bore 26 of the straw passing through the base plate 20 and a plurality of protrusions 30 located on the underside of the external surface of the base plate 20 being constructed in such shapes as cones so as to facilitate the removal of juice and pulp from slices of fruit placed in beverage. Also shown is the contoured edge 34 of the base 20.

Figure 10:
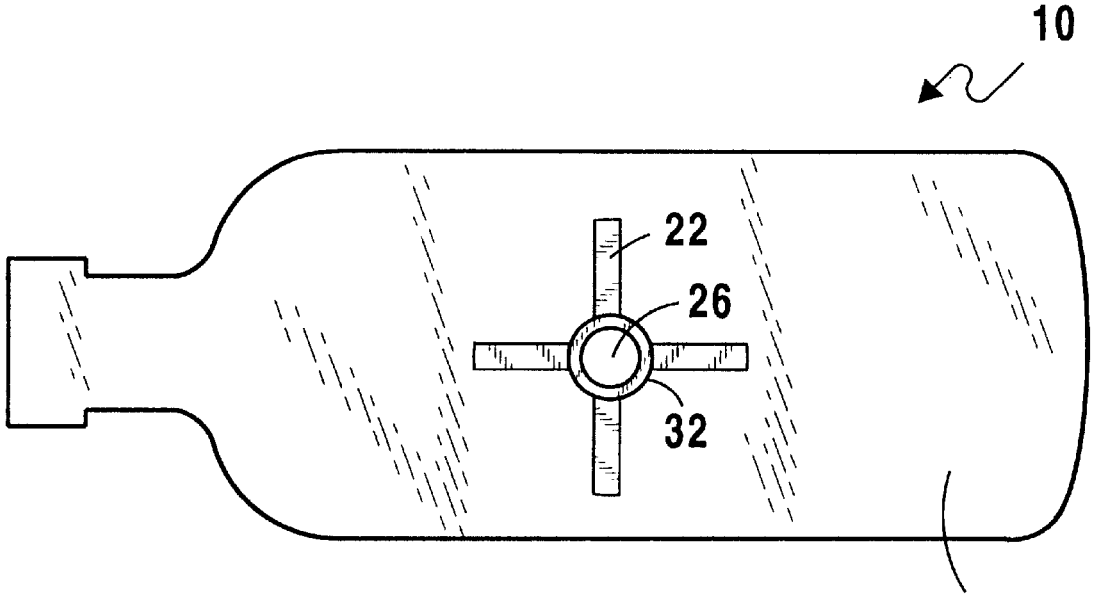
FIG. 10 is a top plan view of another alternate embodiment of the present invention showing the bore and wall of the straw and a plurality of buttresses used as means of support and attachment of the base plate and wherein said base plate has been shaped into the form of a bottle.

Turning to FIG. 10, therein is shown a top plan view of an alternative embodiment of the present invention 10 showing the bore 26 and the wall 32 of the present invention along with a plurality of buttresses 22 used as a means of support and attachment of the base plate 20 which base plate is shaped into the form of an ABSOLUT or other liquor bottle.

Figure 11:
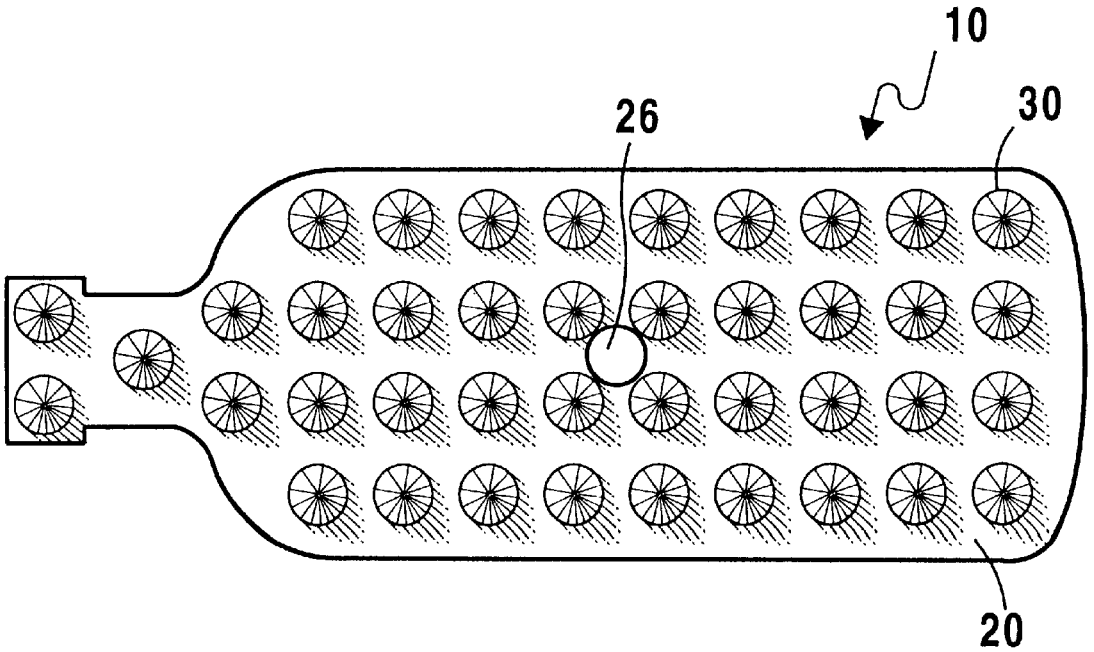
FIG. 11 is a bottom plan view of the alternate embodiment of the present invention shown in FIG. 10. Shown is the bore of the straw passing through the base plate formed as a bottle and a plurality of protrusions arrayed on the external surface of said bottle shaped base plate and being constructed in such shapes as to facilitate the removal of juice and pulp from slices of fruit placed in a beverage.

Turning to FIG. 11, therein is shown a bottom plan view of the alternative embodiment of the present invention 10 shown in FIG. 10, showing the bore 26 of the straw passing through the base plate 20 and a plurality of protrusions 30.

Figure 12:
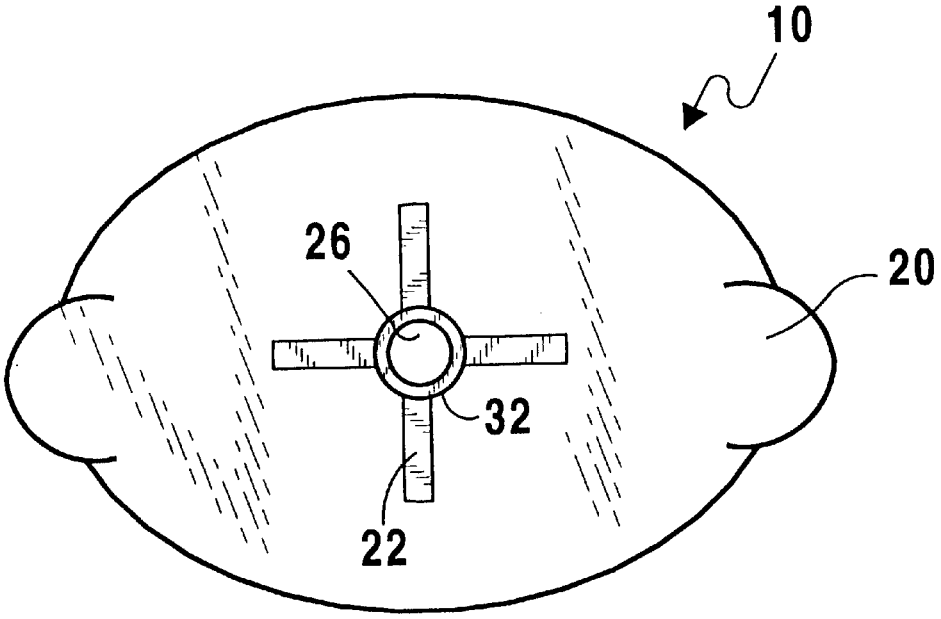
FIG. 12 is a top plan view of another alternate embodiment of the present invention showing the bore and wall of the straw and a plurality of buttresses used as means of support and attachment of the base plate and wherein said base plate has been shaped into the form of a lemon.
Figure 13:
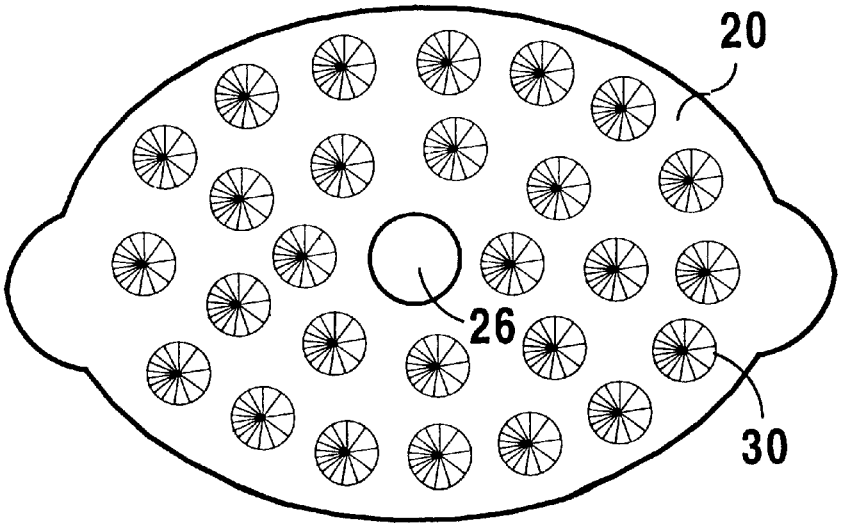
FIG. 13 is a bottom plan view of the alternate embodiment of the present invention shown in FIG. 12. Shown is the bore of the straw passing through the base plate formed as a lemon and a plurality of protrusions arrayed on the external surface of said bottle shaped base plate and being constructed in such shapes as to facilitate the removal of juice and pulp from slices of fruit placed in a beverage.

Turning to FIG. 12, therein is shown a top plan view of the present invention 10 showing the bore or aperture 26 of the tube along with the wall 32 of the tube and the plurality of braces or buttresses 22 wherein the base plate 20 has the shape of a lemon Turning to FIG. 13, therein is shown a bottom plan view of the alternate embodiment shown in FIG. 12, showing the bore 26 of the straw passing through the base plate 20 and a plurality of protrusions 30 located on the underside of the external surface of the base plate 20 being constructed in such shapes as to facilitate the removal of juice and pulp from slices of fruit placed in beverage.

What is claimed is new and desired to be protected by Letters Patent is set forth in the claims:

1. A straw for sipping drinks, comprising:

(a) a generally upright standing tube member;

(b) a base plate located in the perpendicular plane to said tube;

(c) said tube and said base plate having an aperture therein running the full length of the straw; and, (d) a plurality of buttresses which form braces between said base plate and said tube whereby said tube is stabilized.

2. The apparatus of claim 1, said base plate further comprising protrusions on its underside.

3. The apparatus of claim 1, said tube further comprising a plurality of longitudinal slots located on its lower end whereby said straw is prevented from becoming sealed to the drinking vessel.

4. The apparatus of claim 1, wherein said protrusions are cone shaped whereby juice and pulp are extracted from fruit contained in the beverage.

5. The apparatus of claim 1, wherein said buttresses are four in number.

6. The apparatus of claim 1, said base plate further comprises a contoured edge.

7. The apparatus of claim 1, said base plate being shaped like a bottle.

8. The apparatus of claim 1, said base plate being shaped like a lemon.

9. A device for sipping drinks, comprising:

(a) a means for sipping liquids;

(b) said sipping means being generally upright standing;

(c) said sipping means having an aperture therein;

(d) said sipping means having a base plate in the perpendicular plane thereto; and, (e) said base plate having bracing means located between said base plate and said sipping means.

10. The apparatus of claim 9, said base plate further comprising protrusions on its underside.

11. The apparatus of claim 9, said sipping means further comprising a plurality of longitudinal slots located on its lower end whereby said sipping means is prevented from becoming sealed to the drinking vessel.

12. The apparatus of claim 9, wherein said protrusions are cone shaped whereby juice and pulp are extracted from fruit contained in the beverage.

13. The apparatus of claim 9, wherein said bracing means are four in number.

14. The apparatus of claim 9, said base plate further comprises a contoured edge.

15. The apparatus of claim 9, said base plate being shaped like a bottle.

16. The apparatus of claim 9, said base plate being shaped like a lemon.

* * * * *